United States Patent [19]

Fukumoto

[11] Patent Number: 4,682,580

[45] Date of Patent: Jul. 28, 1987

[54] EXHAUST SYSTEM FOR A COOKING APPARATUS

[75] Inventor: Shigeaki Fukumoto, Nara, Japan

[73] Assignee: Sharp Kabushiki Kaisha, Osaka, Japan

[21] Appl. No.: 827,826

[22] Filed: Feb. 10, 1986

[30] Foreign Application Priority Data

Mar. 12, 1985 [JP] Japan ..... 60-35720[U]

[51] Int. Cl.[4] ..... F23J 11/00

[52] U.S. Cl. ..... 126/299 D; 98/115.1

[58] Field of Search ..... 126/299 R, 299 D; 98/115.1

[56] References Cited

U.S. PATENT DOCUMENTS

| | | | |
|---|---|---|---|
| 3,077,825 | 2/1963 | Jenson | 126/299 D |
| 3,719,137 | 3/1973 | Gould | 126/299 D |
| 4,146,016 | 3/1979 | Bowen, Jr. et al. | 126/299 D |
| 4,418,261 | 11/1983 | Jailor et al. | 126/299 D X |
| 4,584,929 | 4/1986 | Järmyr et al. | 126/299 D |

FOREIGN PATENT DOCUMENTS

| | | | |
|---|---|---|---|
| 33547 | 8/1981 | European Pat. Off. | 126/299 D |

*Primary Examiner*—Harold Joyce

*Attorney, Agent, or Firm*—Flehr, Hohbach, Test, Albritton & Herbert

[57] ABSTRACT

A cooking apparatus of this invention such as a combined microwave oven and a range hood includes a structure disposed inside a duct for exhaust gas such that the direction in which exhaust gas is discharged can be adjustably changed. This structure has a concave surface or surfaces for smoothly deflecting a flow of gas incident thereon so that the direction of discharge can be varied easily by changing the orientation of this structure instead of the blower fan.

9 Claims, 14 Drawing Figures

EXHAUST SYSTEM FOR A COOKING APPARATUS

This invention relates to an exhaust system for a cooking apparatus such as a combined microwave oven and a range hood or a ventilator and more particularly to such an exhaust system which can adjustably change the direction of discharge.

As shown in FIG. 10, a cooking apparatus 2 such as a combination microwave oven and a range hood is typically installed on a wall above an existing gas or electrical range 1 and is provided with a blower fan 3 at its upper back section for discharging hot air, smoke, steam, etc. 6 generated by the range 1 below. The hot air, etc. rising from the range 1 are sent through an internal passageway (not shown in FIG. 10) through the microwave oven 2 to the blower fan 3 and further through a joint duct 4 to an existing exhaust duct 5 of an ordinary type. As shown in detail in FIG. 10 which is a cross-sectional view of the exhaust system of such a combination microwave oven 2, the hot air, etc. 6 coming in from below may pass through a grease filter 8 at the bottom of the microwave oven 2, move up inside a passageway 10 bounded by a side wall 9, enter the joint duct 4 by the force of the blower fan 3 through an opening 11 at the top and become discharged into the exhaust duct 5. The direction of rotation of the fan 3 is indicated by an arrow X.

The direction in which the exhaust should be discharged can vary, however, depending on the circumstances, FIG. 11 showing merely a situation where the exhaust duct 5 happens to be located above the microwave oven 2. FIG. 12 shows a different situation where the blower fan 3 is rotated by 90 degrees from the orientation shown in FIG. 11 such that the exhaust from the blower fan 3 is discharged in the forward direction through a charcoal filter 13 disposed in front of the blower fan 3 to clean the exhaust gas to be discharged. When the direction of discharge must be changed thus to the forward direction, an operator must remove a panel 14 at the top and change the orientation of the blower fan 3 by 90 degrees.

If the existing exhaust duct is not above the microwave oven 2 as shown in FIG. 11 but has its opening on a vertical wall as shown in FIG. 13, the operator must similarly remove the top panel 14 and change the orientation of the blower fan 3 by 180 degrees so that the exhaust gas will travel horizontally backward into the exhaust duct 5' in the back wall 15.

In summary, a combined microwave oven and a range hood of the conventional type described above requires a change in the orientation of the blower fan in accordance with the direction in which the exhaust should be discharged. Even after the microwave oven is installed, there are situations in which it becomes desirable to change the direction of discharge periodically, say, between winter and summer times. The changing of the orientation of the blower fan is a troublesome operation and microwave ovens of this type are difficult to clean.

It is therefore an object of the present invention to provide a new type of combined microwave oven and a range hood or a ventilator with which an operator can easily change the direction of discharging the exhaust gas.

The above and other objects of the present invention are achieved by providing inside a duct for the exhaust gas a structure for adjustably changing the direction of discharging the exhaust gas according to the orientation in which it is installed. The exhaust gas accelerated by the blower fan is adapted to hit a concave surface of this structure and to thereby change its direction of flow. Thus, the direction of discharge can be varied by changing the orientation of this deflecting structure while the orientation of the blower fan remains fixed.

The accompanying drawings, which are incorporated in and form a part of the specification, illustrate embodiments of the present invention and, together with the description, serve to explain the principles of the invention.

In these Figures, corresponding parts are indicated by the same numerals.

Figure 1:
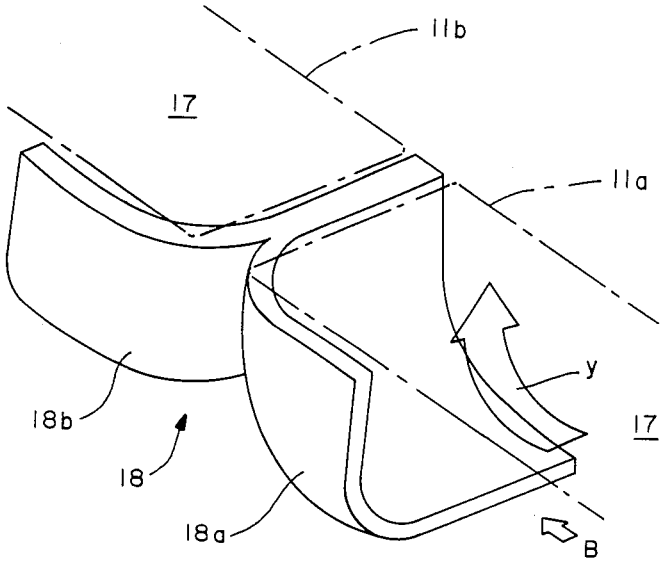
FIG. 1 is a perspective view of a structure for adjustably changing the direction of discharge according to one embodiment of the present invention.
Figure 2A:
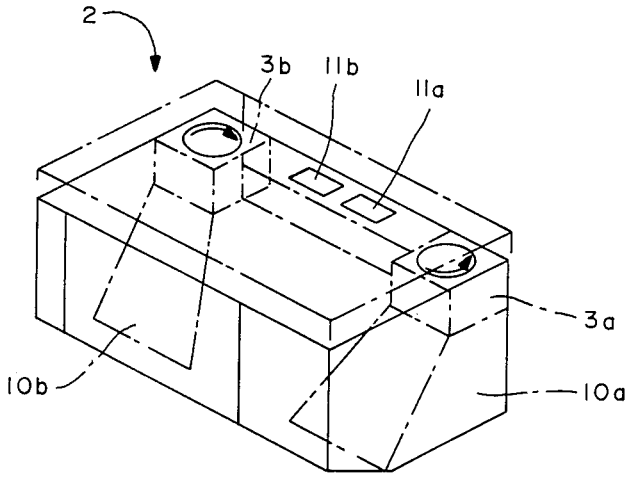
FIG. 2A is a perspective view of a combined microwave oven and a range hood according to one embodiment of the present invention which makes use of the structure shown in FIG. 1.
Figure 10:
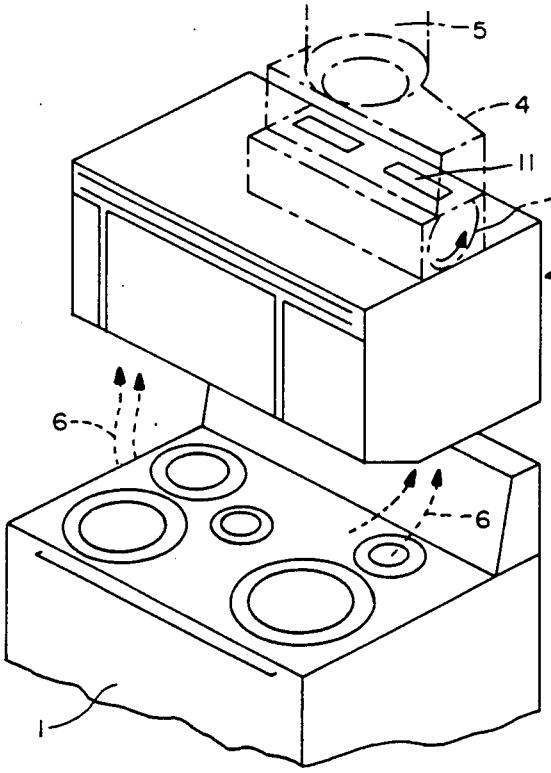
PRIOR ART FIG.—10
FIG. 10 is a perspective view of a conventional combined microwave oven and a range hood.
Figure 11:
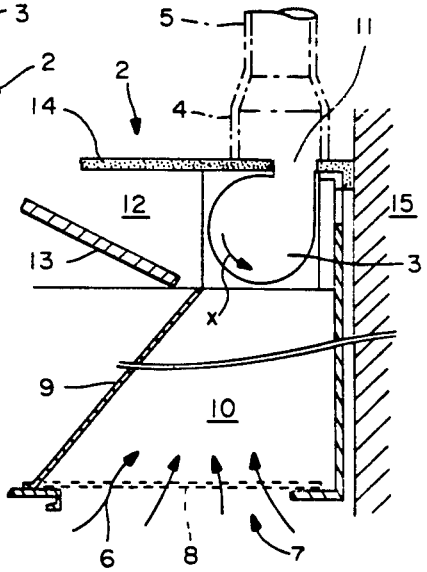
PRIOR ART FIG.—11
FIG. 11 is a side cross-sectional view of the conventional combined microwave oven and a range hood of FIG. 10.
Figure 12:
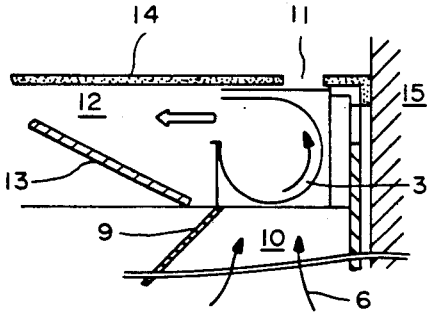
PRIOR ART FIG.—12
FIGS. 12 and 13 are side cross-sectional views showing two different orientations of the blower fan in the conventional combined microwave oven and a range hood of FIG. 10.
Figure 13:
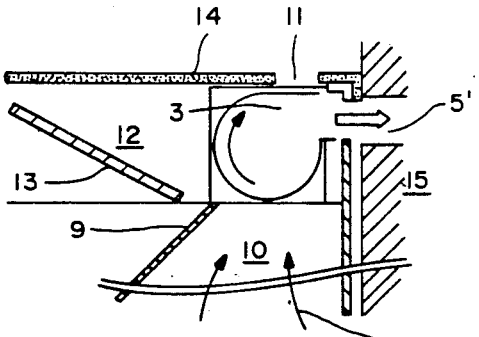
PRIOR ART FIG.—13

It is easily understandable by comparing FIGS. 2A and 10 that the blower fan 3 for a conventional combination cooking apparatus is replaced according to one embodiment of the present invention by a horizontal duct 17 and two fans **3*a* and 3*b* at both ends thereof such that the exhaust gas accelerated by the fans 3*a* and 3*b* respectively through ducts 10*a* and 10*b* is blown into the horizontal duct 17 and then into a joint duct (not shown in FIG. 2A) through openings 11*a* and 11*b* provided on the top surface of the microwave oven cabinet. In FIG. 1, numeral 18 generally indicates a structure adapted to be disposed inside the duct 17 between the openings 11*a* and 11*b* such that two streams of the exhaust gas flowing inside the duct 17 from the fans 3*a* and 3*b* at opposite ends thereof will not collide with each other but smoothly change their directions and pass through the openings 11*a* and 11*b* to enter the joint duct together. As best shown in FIG. 1, the structure 18 consists of two cup-shaped members 18*a* and 18*b* which are joined together. Each of the cup-shaped members 18*a* and 18*b* may be viewed as a nearly spherical shell with a concave inner surface cut by three mutually perpendicular planes passing through its center such that, for example, the exhaust gas from the fan 3***a* will be deflected smoothly inside the duct 17 as shown by the arrow Y and passed through the opening 11*a* in the cabinet.

Figure 3:
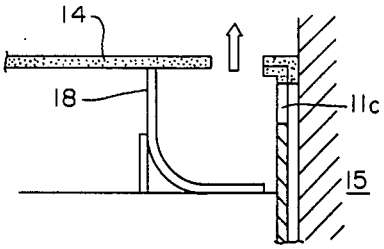
FIGS. 3 through 5 are side cross-sectional views of a portion of the microwave oven of FIG. 2A, showing the directions in which the exhaust gas can be discharged according to the orientation of the structure of FIG. 1.

FIG. 3 is a cross-sectional view taken along the arrow B of FIG. 1 and shows the orientation of the structure 18 when it is desired to deflect the exhaust gas into the upward direction. Since openings 11*c* provided on the back wall of the cabinet are usually blocked by the kitchen wall 15 on which the cabinet is mounted, there is no need to take the trouble of closing them but they may be closed with a tape or the like if it is desired to prevent the wall 15 from becoming dirty by the smoke, etc. in the exhaust gas. Alternatively, the back wall of the cabinet may be provided with incisions instead of completed openings 11*c* such that a user can use a screw driver or the like, whenever necessary, to make openings 11*c* by bending the sections adjacent to the incisions. In this manner, the user can send the exhaust gas in the upward or backward direction merely by opening or closing the openings 11*c* without disassembling the cabinet.

Figure 4:
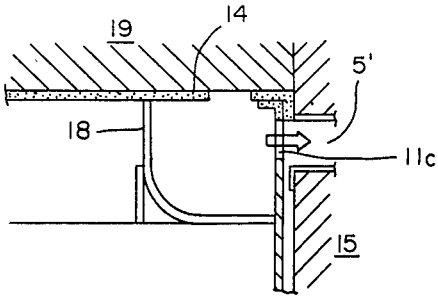

FIG. 4 shows a situation where the exhaust gas is discharged into a horizontal exhaust duct 5' at the back. The exhaust gas, in this situation, is deflected smoothly by the concave inner surfaces of the structure 18 into the backward direction towards the openings 11*c*. The upper openings 11*a* and 11*b* may be blocked by the kitchen ceiling 19 if it is in contact with the top panel 14 of the cabinet. Alternatively, a tape or the like may be used to close them in order to prevent the exhaust gas from passing through them. In summary, no troublesome work is needed if the exhaust gas is to be discharged upwards or to the back.

Figure 5:
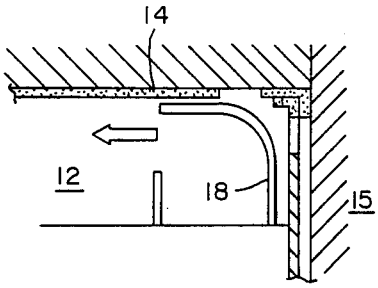

FIG. 5, by contrast, illustrates a situation where the structure 18 is rotated by 180 degrees in a vertical plane from the orientation shown in FIGS. 3 and 4 such that the exhaust gas will be discharged to the front. Although it becomes necessary in this situation to open the top panel 14 of the cabinet, the work involved in turning the structure 18 around is much easier than the work of changing the orientation of a heavy blower fan with wires connected to it.

The work of changing the orientation of the flow-deflecting structure can be made still easier. According to another embodiment of the present invention illustrated in FIG. 6, an incision 20 is provided to a section walls of the structure 18. An end portion 18*c* of the structure 18 is thus adapted to be bent along the line of incision as shown by an arrow in FIG. 6 for opening a passage 21 to the front for the exhaust gas. FIG. 7 is a view taken along the line 7—7 of FIG. 6, showing a small inwardly bent section 22 on a side panel of the horizontal duct 17 so as to support the end portion 18*c* of the structure 18 and to keep it in its bent position.

Figure 6:
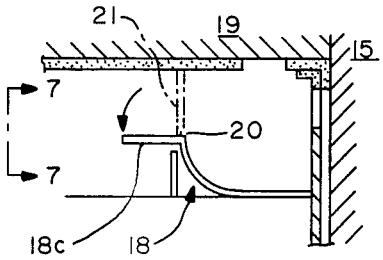
FIG. 6 is a side cross-sectional view of the microwave oven of FIG. 2A and showing a flow-deflecting structure according to another embodiment of the present invention.
Figure 7:
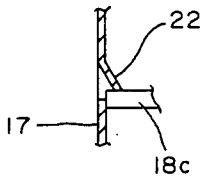
FIG. 7 is a view taken along the line 7—7 of FIG. 6.
Figure 8:
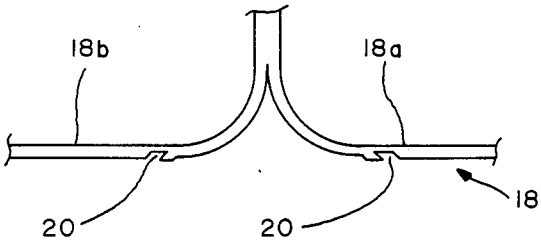
FIGS. 8 and 9 are plan views of flow-deflecting structures according to further embodiments of the present invention.

FIG. 8 is a plan view of the cup-shaped members 18*a* and 18*b* of the structure 18 according to the embodiment of FIGS. 6 and 7, showing the incisions 20 formed on the outer (convex) surfaces of the spherical shells such that the end portions can be bent along them in the way shown in FIG. 6.

Figure 2B:
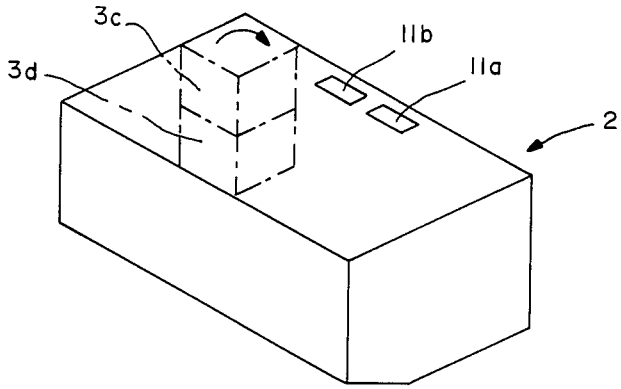
FIG. 2B shows a cooking apparatus according to another embodiment.
Figure 9:
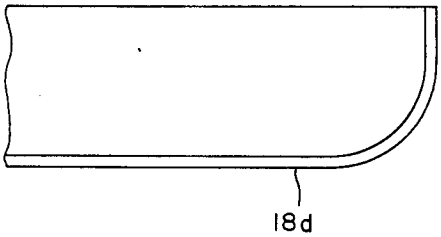

FIG. 2B is a perspective view of a cooking apparatus of the present invention according to another embodiment which is characterized in that two fans 3*c* and 3*d* are placed one on top of the other at one side of the microwave oven 2. In this case, a structure for adjusting the direction of discharge may take the form of a single cup-shaped shallow member 18*d* of FIG. 9 without a partition at the center because it is adapted to be connected to both fans 3*c* and 3*d* in common. Incisions of the type shown in FIGS. 6 and 8 may also be provided to the member 18*d* of FIG. 9 and a section which can be bent inward as shown in FIG. 7 may also be provided to the side wall enclosing it to support the member 18*d*.

In summary, the microwave oven according to this invention is characterized by its exhaust system having inside its duct for the exhaust gas a structure for adjusting the direction of discharge with one or two smooth flow-deflecting surfaces which can be adjustably rotated, and this obviates the necessity for the cumbersome job of changing the orientation of the heavy blower fan.

The foregoing description of the invention has been presented for purposes of illustration and description. It is not intended to be exhaustive or to limit the invention to the precise form disclosed, and obviously many modifications and variations are possible in light of the above teaching. Such modifications and variations which may be apparent to a person skilled in the art are intended to be included within the scope of this invention.

What is claimed is:

1. A cooking apparatus comprising a horizontal duct with inlets at both ends thereof, said duct being so connected as to admit exhaust gas thereinto through said inlets and to cause said admitted exhaust gas to travel inside said duct toward each other, said duct having a horizontal outlet and a vertical outlet, and a structure disposed inside said duct and supported rotatably around a horizontal axis, said structure serving at a first angular position around said axis to deflect said exhaust gas approximately by 90 degrees toward said horizontal outlet, said structure serving at a second angular position around said axis to deflect said exhaust gas approximately by 90 degrees toward said vertical outlet.

2. The cooking apparatus of claim 1 which is a combined microwave oven and a range hood and further comprises one or more blower fans.

3. The cooking apparatus of claim 1 wherein said structure has one or more concave surfaces for smoothly deflecting a flow of gas incident thereon by approximately 90 degrees.

4. The cooking apparatus of claim 1 wherein said duct has a blower fan at each end thereof.

5. The cooking apparatus of claim 1 wherein said first and second angular positions are apart from each other by 90 degrees around said axis.

6. The cooking apparatus of claim 1 wherein said vertical outlet is above said structure.

7. The cooking apparatus of claim 1 wherein said horizontal and vertical outlets are immediately adjacent to said structure.

8. The cooking apparatus of claim 3 wherein said structure has two concave surfaces which individually face said inlets irrespective of whether said structure is at said first or second angular position around said axis.

9. The cooking apparatus of claim 8 wherein said concave surfaces have incisions formed therein such that said structure can be bent along said incisions to open passageways for said exhaust gas.

* * * * *